US006749466B1

(12) United States Patent
Milner et al.

(10) Patent No.: US 6,749,466 B1
(45) Date of Patent: Jun. 15, 2004

(54) ELECTRICAL CONNECTOR CONTACT CONFIGURATIONS

(75) Inventors: John J. Milner, Milford, CT (US); Raul G. Pereira, Cumberland, RI (US); Alan C. Miller, Guilford, CT (US); Joseph E. Dupuis, Ledyard, CT (US); Randolph R. Ruetsch, Branchburg, NJ (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/638,179

(22) Filed: Aug. 14, 2000

(51) Int. Cl.[7] ..... H01R 24/00
(52) U.S. Cl. ..... 439/676; 439/76.1; 439/941
(58) Field of Search ..... 439/76.1, 676, 439/404, 405, 395, 941

(56) References Cited

U.S. PATENT DOCUMENTS

| | | | | |
|---|---|---|---|---|
| 4,975,078 A | | 12/1990 | Stroede et al. | 439/405 |
| 5,186,647 A | | 2/1993 | Denkmann et al. | 439/295 |
| 5,228,872 A | | 7/1993 | Liu | 439/607 |
| 5,376,018 A | | 12/1994 | Davis et al. | 439/405 |
| 5,580,270 A | | 12/1996 | Pantland et al. | 439/395 |
| 5,586,914 A | | 12/1996 | Foster, Jr., deceased et al. | 439/676 |
| 5,628,647 A | | 5/1997 | Rohrbaugh et al. | 439/404 |
| 5,639,266 A | | 6/1997 | Patel | |
| 5,791,942 A | | 8/1998 | Patel | |
| 5,997,358 A | * | 12/1999 | Adriaenssens et al. | 439/676 |
| 6,093,048 A | * | 7/2000 | Arnett et al. | 439/404 |
| 6,157,542 A | * | 12/2000 | Wu | 439/76.1 |
| 6,162,076 A | * | 12/2000 | Francaviglia | 439/676 |
| 6,176,742 B1 | * | 1/2001 | Arnett et al. | 439/676 |
| 6,186,834 B1 | * | 2/2001 | Arnett et al. | 439/676 |

OTHER PUBLICATIONS

Photograph of Hubbell Premise Wiring 5110 Jack.
Photograph of Hubbell Premise Wiring HD USOC Jack.

* cited by examiner

*Primary Examiner*—P. Austin Bradley
*Assistant Examiner*—Edwin A. Leon
(74) *Attorney, Agent, or Firm*—Mark S. Bicks; Alfred N. Goodman

(57) ABSTRACT

A wire connecting unit for an electrical connector for communication and data transmission systems includes a circuit board with a free and a near end and having four pairs of contacts mounted in a cantilever manner. The wire connecting unit has specific contact configurations that reduce crosstalk, attenuation, propagation delay, and other electrical and magnetic properties that interfere with communication and data transmission. In one embodiment, a first row of contacts extends generally upwardly and backwardly from the free end of the printed circuit board toward the near end, and a second row of contacts placed further from the free end of the printed circuit board than the first row of contacts extends generally upwardly and backwardly from the free end toward the near end. Each adjacent contact can have only a single push foot that extends laterally and outwardly from its proximal end, remote from the other contact in the respective pair, allowing the contacts to be placed relatively close together to further reduce the electrical and magnetic properties that interfere with communication and data transmission.

6 Claims, 7 Drawing Sheets

ELECTRICAL CONNECTOR CONTACT CONFIGURATIONS

REFERENCE TO RELATED APPLICATION

This application is related to U.S. patent application Ser. No. 09/250,186 of John J. Milner, Joseph E. Dupuis, Richard A. Fazio, and Robert A. Aekins, filed Feb. 16, 1999, and entitled "Wiring Unit with Angled Insulation Displacement Contacts"; the subject matter of which is hereby incorporated by reference.

FIELD OF THE INVENTION

The present invention relates to a wire connecting unit for an electrical connector for communication and data transmission systems. The wire connecting unit has contact configurations that reduce crosstalk attenuation, propagation delay, and other electrical properties that interfere with communication and data transmission. More particularly, the present invention relates to a wire connecting unit for an electrical connector jack that terminates in eight conductors, with the eight conductors being configured to reduce electrical interference and interconnect with a plug.

BACKGROUND OF THE INVENTION

Due to significant advancements in telecommunications and data transmission speeds over unshielded twisted pair cables, the connectors (jacks, receptacles, patch panels, cross connects, etc.) have become critical factors in achieving high performance in data transmission systems, particularly at the higher frequencies. Some performance characteristics, particularly near end crosstalk, can degrade beyond acceptable levels at new, higher frequencies in the connectors unless adequate precautions are taken.

Often, wiring is pre-existing Standards define the interface geometry and pin separation for the connectors, making any changes to the wiring and to the connector interface geometry and pin separation for improving performance characteristics cost prohibitive.

The use of unshielded twisted pair wiring and the establishment of certain standards for connector interface geometry and pin separation were created prior to the need for high-speed data transmissions. Thus, while using the existing unshielded twisted pair wiring and complying with the existing standards, connectors must be developed that fulfill the performance requirements of today's higher speed communications, to maintain compatibility with the existing connectors.

Additionally, the wire connecting unit contacts are traditionally attached to a printed circuit board using solder attachments or compliant pins. Both assembly techniques have traditionally required a push foot mechanism on either side of the contact. These push foot mechanisms enable the contact to be inserted into the printed circuit board with the assembly fixturing. Since the contacts are on 0.040" spacing and due to the annular (plated through) ring geometry requirements of a printed circuit board, contacts having a push foot on each side of each contact cannot be placed adjacent to each other in the same row. To space the contacts 0.040" apart a single push foot would have to be utilized; however, a single push foot on one side of the contact creates a moment and can make it difficult to insert the contact into the printed circuit board.

Conventional connectors of this type are disclosed in U.S. Pat. No. 4,975,078 to Stroede, U.S. Pat. No. 5,186,647 to Denkmann et al, U.S. Pat. No. 5,228,872 to Liu, U.S. Pat. No. 5,376,018 to Davis et al, U.S. Pat. No. 5,580,270 to Pantland et al, U.S. Pat. No. 5,586,914 to Foster et al and U.S. Pat. No. 5,628,647 to Roharbaugh et al, the subject matter of each of which is hereby incorporated by reference.

SUMMARY OF THE INVENTION

Accordingly, an object of the present invention is to provide a wire connecting unit for an electrical connector having a contact configuration that improves performance characteristics, but does not require changing standard connector interface geometry and contact separation.

Another object of the present invention is to provide a wire connecting unit for an electrical connector that is simple and inexpensive to manufacture and use.

A further object of the present invention is to provide a wire connecting unit for an electrical connector having contacts that connect to a printed circuit board and have only one push foot to allow adjacent contacts to be positioned in dose proximity in the same row.

The foregoing objects are basically obtained by a wire connecting unit for an electrical connector, comprising a circuit board having first and second areas, the first area having a free end and a near end. First, second, and third pairs of contacts are mounted in the first area adjacent the free end in a cantilever manner and extend upwardly and backwardly toward the near end. A fourth pair of contacts are mounted in the first area adjacent the near end in a cantilever manner and extend upwardly and forwardly toward the free end.

The foregoing objects are also obtained by a wire connecting unit for an electrical connector, comprising a circuit board having a wire termination portion and a plug connection portion. The plug connection portion has a first area and a second area, the first area having a proximal end and a distal end. A first plurality of contacts is mounted in the first area adjacent the distal end in a cantilever manner and extend generally upwardly and backwardly toward the wire termination portion. At least two of the contacts in the first plurality of contacts are adjacent to each other and have a single push foot extending therefrom A second plurality of contacts is mounted in the first area adjacent the proximal end and extend upwardly and backwardly toward the wire termination portion.

By forming the wire connecting unit for the electrical connector in as described, the connector will have improved performance characteristics, without changing the standard plug connector geometry and contact definitions. By placing the wire connecting unit's contacts in a particular configuration, maximum separation between critical contacts and positioning of other contacts adjacent each other to cancel out Gaussian fields is achieved, thereby improving electrical performance of the electrical connector. Additionally, by having only one push foot, the contacts can be placed relatively close together, increasing the contacts' ability to cancel out the Gaussian field of the adjacent contact and thereby increasing electrical performance.

Other objects, advantages and salient features of the invention will become apparent from the following detailed description, which, taken in conjunction with the annexed drawings, discloses preferred embodiments of the invention.

As used herein, terms, such as "upwardly", "downwardly", "forwardly" and "backwordly", are relative directions, do not limit the connecting unit to any specific orientation.

BRIEF DESCRIPTION OF THE DRAWINGS

Referring to the drawings which form a part of this disclosure.

DETAILED DESCRIPTION OF THE PREFERRED EMBODIMENT

Figure 1:
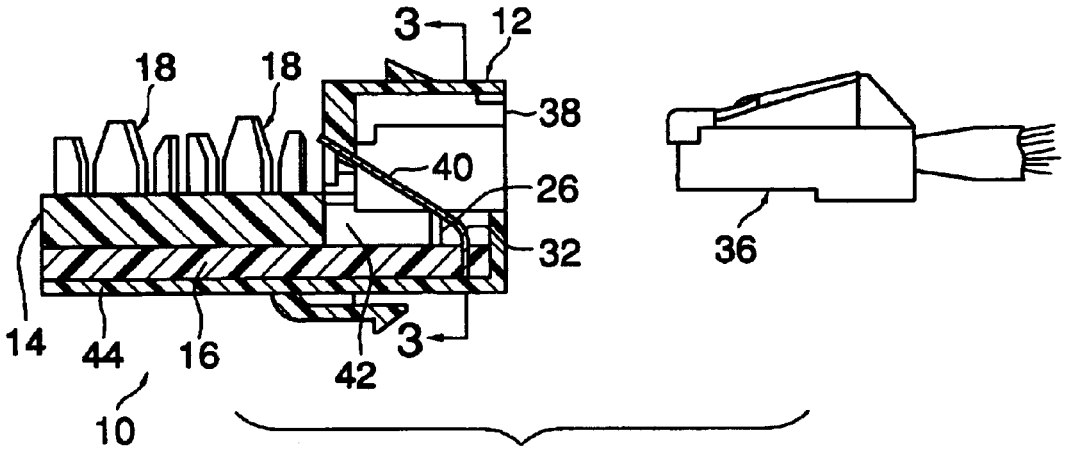
FIG. 1 is a side elevational view in section of a wire connecting unit for an electrical connector according to the first embodiment of the present invention, prior to engagement with a plug.
Figure 2:
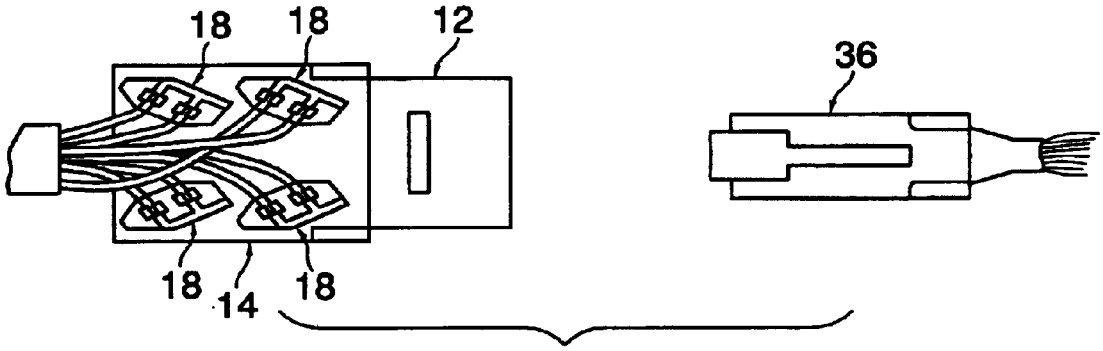
FIG. 2 is a top view of the wire connecting unit for an electrical connector of FIG. 1 prior to engagement with a plug.
Figure 3:
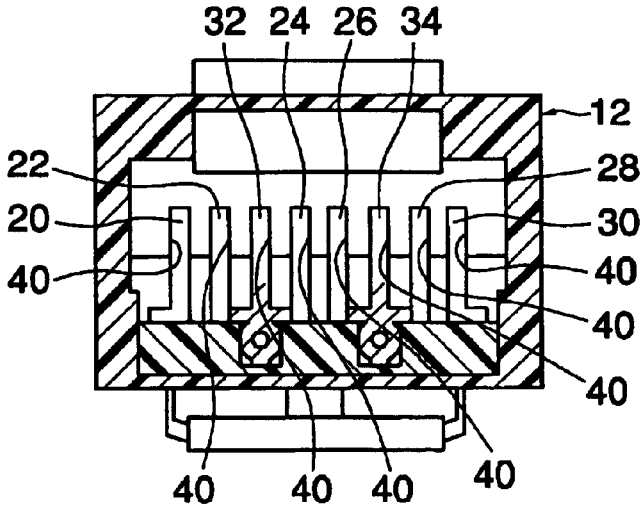
FIG. 3 is an end elevational view in section of the wire connecting unit taken along lines 3—3 of FIG. 1.

A high density jack 10 for telecommunication systems according to the present invention is schematically or diagrammatically illustrated in FIGS. 1–3. The connector comprises a connector body or housing 12 and a wire connecting unit 14 coupled to the connector body. The wiring unit comprises a printed circuit board 16 on which terminals 18 are mounted. The terminals 18 are standard 110 insulation displacement contacts (IDC), and are coupled to standard wiring as shown specifically in FIG. 2. Through the circuit board, these terminals are electrically and mechanically coupled to resilient contacts 20, 22, 24, 26, 28, 30, 32 and 34. The resilient contacts extend into the connector body in a configuration for electrical connection to a conventional or standard plug 36, particularly an RJ plug.

if In the illustrated embodiment, connector body 12 is in a form to form a jack. However, the connector body can be of any desired form, such as a plug, cross connect or any other connector in the telecommunications or data transmission field.

Connector body 12 is generally hollow having a forwardly opening cavity 38 for receiving a conventional RJ plug. Eight parallel slots 40 extend through the connector body and open on its rear face. One of resilient contacts 20–34 is located in each of the slots.

Below slots 40 and remote from plug receiving cavity 38, the connector body has a recess 42. Recess 42 opens on the rear face of connector body 12 and is adapted to receive a portion of circuit board 16, specifically the portion of the circuit board on which the resilient contacts 20–34 are mounted. A shelf 44 can extend rearwardly from the connector body below recess 42. Shelf 44 supports circuit board 16 and facilitates the coupling between the circuit board and the connector body.

As seen in FIGS. 4 and 7–16, printed circuit board 16 is divided into a relatively narrower plug connection portion or first area 46 and a relatively wider termination or second area 48. Plug connection portion 46 is further divided into a relatively narrower nose or first area 50 having a free or distal end 52 and a proximal end 64 and into a relatively wider or second area 56 having a near end 58.

Figure 4:
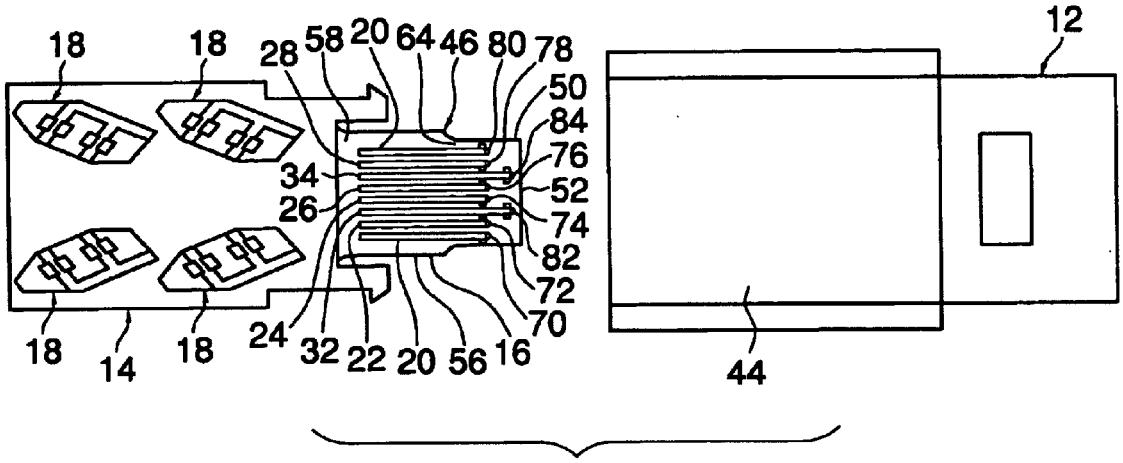
FIG. 4 is an exploded top plan view of the wire connecting unit of FIG. 1.
Figure 5:
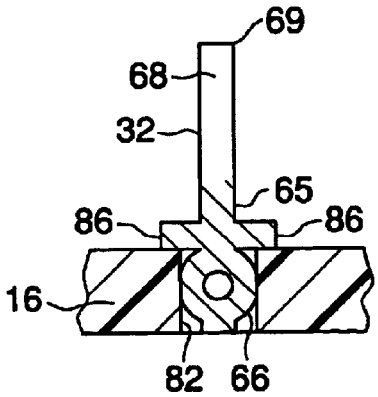
FIG. 5 is an enlarged, partial, end elevational view in section of an electrical contact for the wire connecting unit, shown in FIG. 3, having a push foot on two separate sides.
Figure 6:
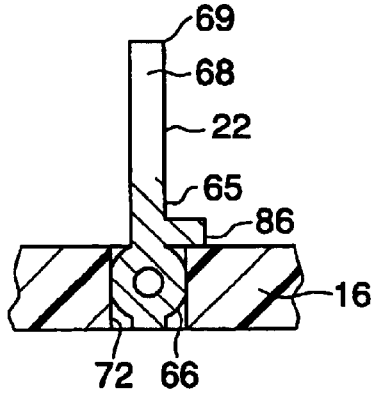
FIG. 6 is an enlarged, partial, end elevational view in section of an electrical contact for the wire connecting unit, shown in FIG. 3, having only one push foot.

As seen in FIGS. 3 and 5–7, each resilient contact 20–34 comprises a proximal end 65, a base portion 66, a contact portion 68, and a distal end 69. The base portions are received and are electrically connected to the circuit paths provided on the printed circuit board and have a laterally protrusion or push foot mechanism 86 on either one side only as seen on contacts 20–28 or on both sides as seen on contact 30 and 32. The contact portions are substantially parallel and extend in a cantilever manner from the base portions and are bent at an angle for receipt within slots 40 of connector body 12. As seen in FIGS. 4–6, holes or apertures 70, 72, 74, 76, 78, 80, 82, and 84 in printed circuit board 16 provide connections in the circuit board for the resilient contacts 20–34 either through traditional solder attachment or compliant pin. The compliant pin technique frictionally fits base portion 66 into the holes in printed circuit board 16. Both assembly techniques require push foot 86.

Push foot mechanism 86 enables the contacts to be inserted into the printed circuit board 16 with an assembling fixture. To comply with the contact geometry of the standard plug 36 and the annular (plated through) ring geometry requirements in a printed circuit board, the jack contacts must be spaced apart by 0.040 inch. Having a push foot on one side allows the contacts to be positioned laterally in one row on 0.040 inch spacing. By immobilizing the moment of the contact and applying pressure to the single push foot, the contact can be insert into its respective aperture in the circuit board. The closer positioning of the contacts allows greater reduction or cancellation of adjacent Gaussian fields, improving the performance of the connector.

Figure 7:
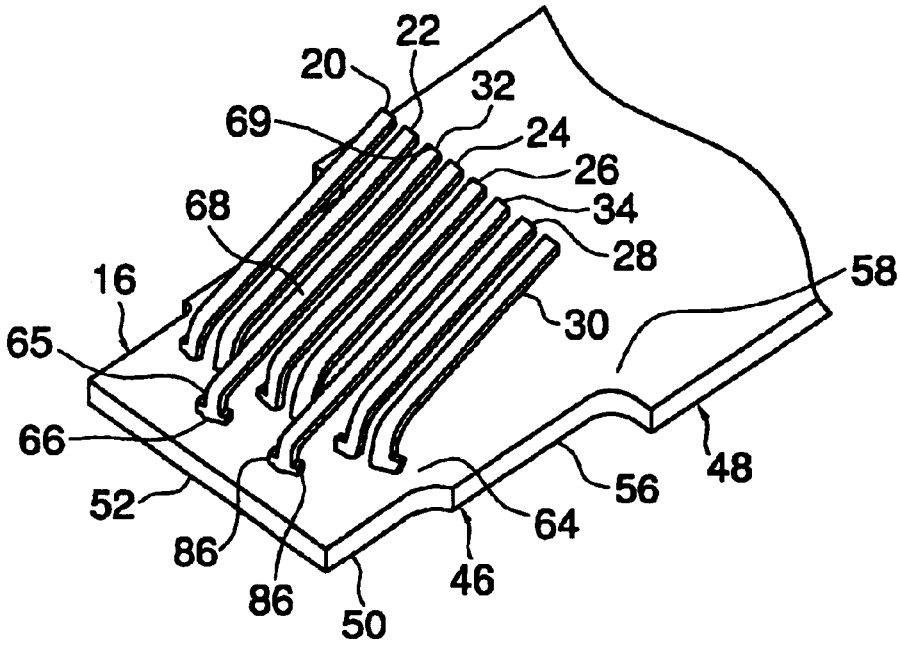
FIG. 7 is a partial top perspective view of a printed circuit board for a wire connecting unit having the contact configuration of FIG. 1.

Plug connection portion 46 comprises eight holes or apertures 70, 72, 74, 76, 78, 80, 82, and 84. Each of the holes is internally plated with an electrically conductive material, as conventionally done in this art. The holes preferably are arranged in two rows. The first row has one pair of contacts 32 and 34 mounted in the first area of the plug connection portion 46 adjacent the free or distal end 52. The contacts generally extend perpendicularly to the circuit board and then extend generally upwardly and backwardly toward the wire termination portion 48 at angle of about 60–70 degrees relative to the printed circuit board 16, as seen in FIGS. 4 and 7. The second row has 3 pairs of contacts 20, 22, 24, 26, 28, and 30 mounted in the first area 50 of the plug connection portion 46 adjacent the proximal end 64 and extending upwardly and backwardly toward said wire termination portion 56 at angle of about 60–70 degrees relative to the printed circuit board 16. The contacts in the second row (i.e. 20 and 22, 24 and 26, and 28 and 30) each has a single push foot 86 extending laterally and outwardly from the proximal end 65 of its respective contact, away from the other contact in its respective pair of contacts, as seen specifically in FIG. 6. The two contacts in the first row have push feet or push foot mechanisms extending from both sides of their proximal ends, as seen specifically in FIG. 5. In this configuration, the physical separation of contacts 30 and 32 enhances the near end cross talk performance.

Particularly, contacts 24 and 26 form a first pair and contacts 34 and 36 form a second pair. These first and second pairs, because of their positions, pose the greatest crosstalk problem. The increased separation between these two pair reduces crosstalk problems.

Figure 8:
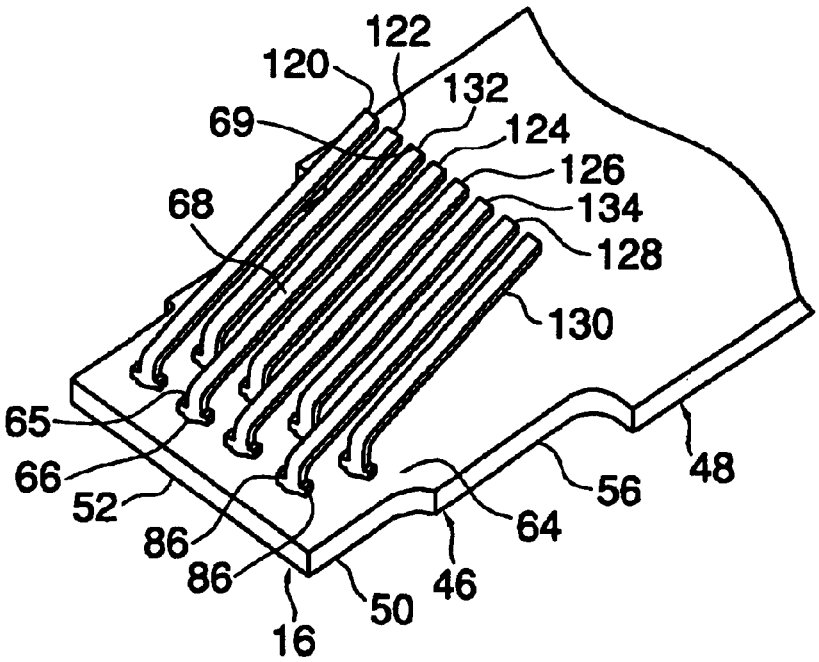
FIG. 8 is a partial top perspective view of a printed circuit board for a wire connecting unit having a contact configuration according to a second embodiment of the present invention.

Embodiment of FIG. 8

As seen in FIG. 8, the contacts can be arranged in two rows of four each, which rows are laterally offset from one another. Specifically, in this configuration, the pairs of contacts are equally split with contacts 120, 126, 128 and 132 forming a first row of contacts mounted in the first area 50 of the plug connection portion 46 adjacent the free or distal end 52. Initially, the contacts generally extend substantially perpendicularly to the printed circuit board and then extend generally upwardly and backwardly toward the wire termination portion 48. Contacts 122, 124, 130 and 134 form a second row of contacts mounted in the first area 50 of the plug connection portion 46 adjacent the proximal end 64 and extend upwardly and backwardly toward said wire termination portion 48. Each contact in the first row of contacts is substantially the same distance from free end 52 as each other contact in the first row. Each contact in the second row of contacts is substantially the same distance from the proximal end 64 as each other contact in the second row. The contacts in this configuration have a similarity of neutral axis length or length measured from the printed circuit board to the point in which the contact mates with the plug. A similarity in neutral axis length optimizes the skew performance of the connectors.

The FIG. 8 configuration maximizes the spacing of the contacts in the row and the two contacts of each pair. The spacing in each row facilitates the use of two push feet on each contact.

Figure 9:
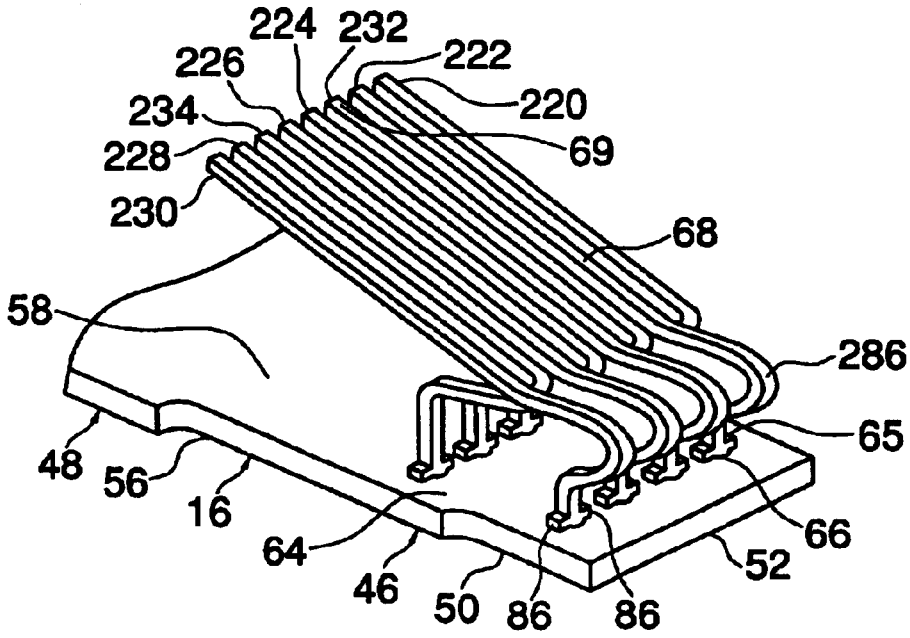
FIG. 9 is a partial top perspective view of a printed circuit board for a wire connecting unit having a contact configuration according to a third embodiment of the present invention.

Embodiment of FIG. 9

In the embodiment of FIG. 9, the contacts are arranged in a similar dual row configuration as that of the embodiment shown in FIG. 8. However, in this embodiment, the first row of contacts (i.e. contacts 220, 226, 228 and 232) each extend substantially vertically from the printed circuit board, curve toward the free end 52, then curve back toward the proximal end 64, creating a protrusion 288, before extending back toward the near end 58 of the printed circuit board. Additionally, the second row of contacts (i.e. contacts 222, 224, 230 and 234) each extend substantially vertically from the printed circuit board 16 then curve toward the free end 52 before extending back toward the near end 58 of the printed circuit board. This design creates greater separation between the two rows and increases the neutral axis length or the distance of the contact from the surface of the printed circuit board to the mating point with plug 36. By lengthening the neutral axis length the contacts can be more accurately tuned, therefore making the electromagnetic interference equal and opposite between pairs of the contacts. However, increasing the neutral axis length increases the compensation created by the electromagnetic field, and therefore the electromagnetic interference induced across the interface is greater than similar configurations.

Figure 10:
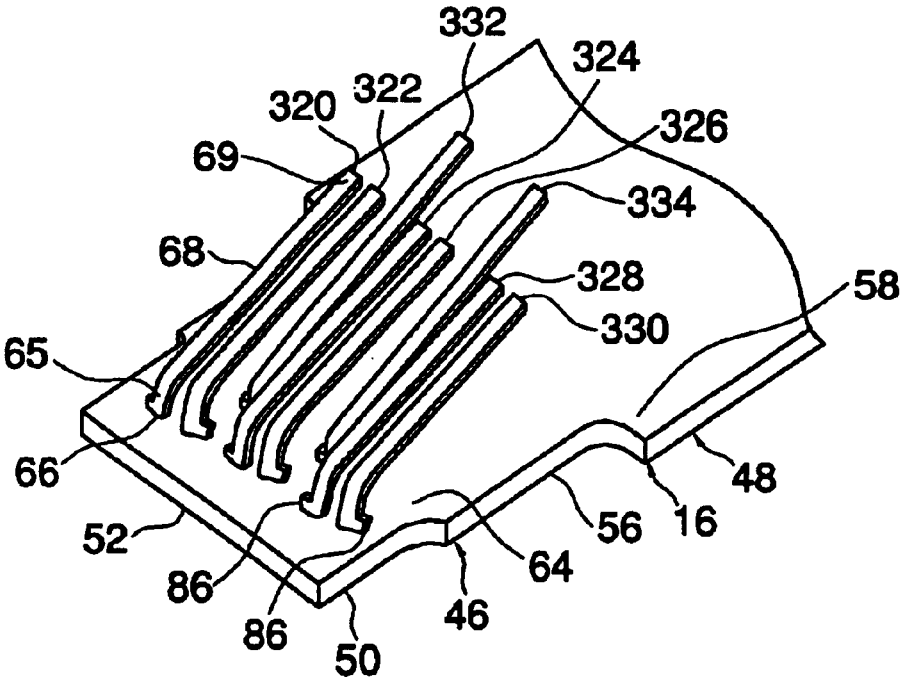
FIG. 10 is a partial top perspective view of a printed circuit board for a wire connecting unit having a contact configuration according to a fourth embodiment of the present invention.

Embodiment of FIG. 10

In the embodiment of FIG. 10, the contacts are arranged in a dual row configuration The first row has 3pairs of contacts 320, 322, 324, 326, 328, and 330 mounted in the first area 50 of the plug connection portion 46 adjacent the distal end 52. Initially, the contacts extend substantially perpendicularly to the printed circuit board and then extend upwardly and backwardly toward said wire termination portion 48. The second row has one pair of contacts 332 and 334 mounted in the first area 50 of the plug connection portion 46 adjacent the proximal end 64 and extend generally upwardly and backwardly toward the wire termination portion 48. Each contact of the pairs of contacts in the first row (i.e. 320 and 322, 324 and 326, and 328 and 330) has a single push foot 86 extending laterally and outwardly from its proximal end 65, remote from the other contact in its respective pair of contacts. The contacts in the second row have a push foot mechanism extending from each side of their proximal ends 65. This configuration of contacts provides increase separation between of the pair of contacts 332 and 334, particularly, relative to the pair of contacts 324 and 326, reducing unwanted electromagnetic coupling between these two contacts.

Figure 11:
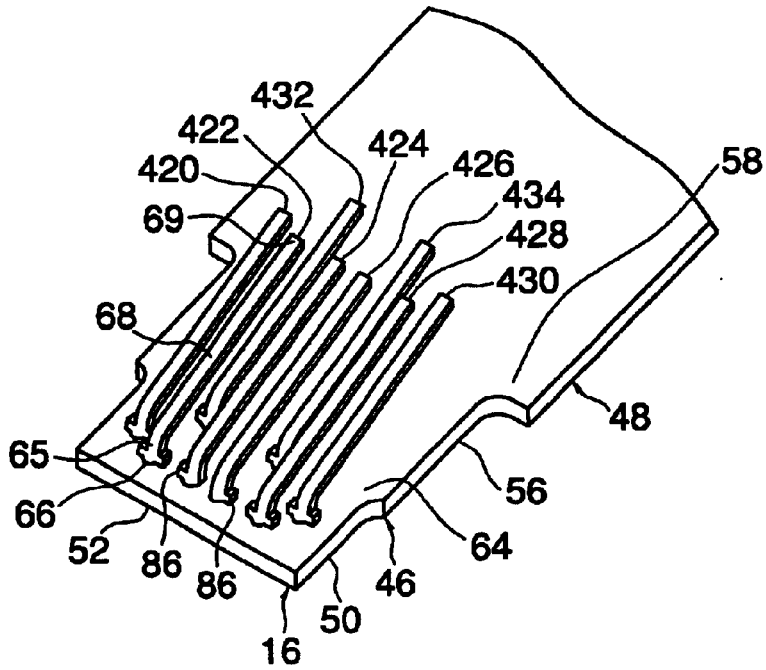
FIG. 11 is a partial top perspective view of a printed circuit board for a wire connecting unit having a contact configuration according to a fifth embodiment of the present invention.

Embodiment of FIG. 11

In the embodiment of FIG. 11, the contacts are arranged in three rows. The first row comprises contacts 422, 424, 426, and 428 mounted in the first area 50 of the plug connection portion 46 adjacent the distal end 52. Initially, the contacts extend substantially perpendicularly to the printed circuit board and then extend upwardly and backwardly toward wire termination portion 48. The second row has two contacts 420 and 430 mounted in the first area 50 of the plug connection portion 46 adjacent the free or distal end 52, but further from the distal end then the first row of contacts, and extending generally upwardly and backwardly toward the wire termination portion 48. The third row has one pair of contacts 432 and 434 mounted in the first area 50 of the plug connection portion 46 adjacent the proximal end 64 and extending generally upwardly and backwardly toward the wire termination portion 48. The contacts of the inside pair 424 and 426, in the first row, each has a single push foot 86 extending laterally and outwardly from its proximal end 65, remote from the other contact of that pair of contacts. The contacts in the second and third rows have push foots extending from each side of their proximal ends 65. By forming a contact configuration in this manner, performance is similar to the embodiment in FIG. 10, and electromagnetic coupling between contacts 432 and 434 is reduced due to the separation of these two contacts.

Figure 12:
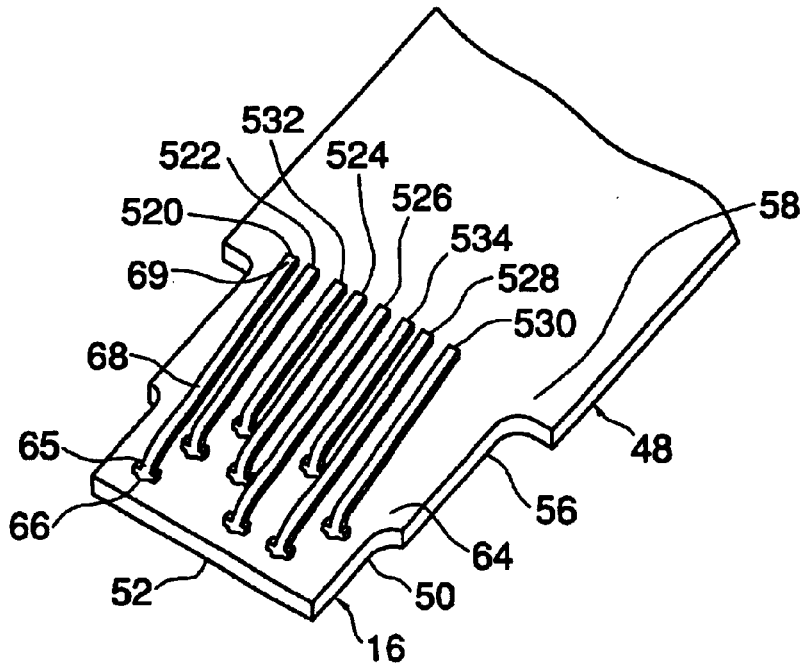
FIG. 12 is a partial top perspective view of a printed circuit board for a wire connecting unit having a contact configuration according to a sixth embodiment of the present invention.

Embodiment of FIG. 12

The embodiment of FIG. 12 also uses a three row configuration. However, in this configuration, the first row comprises contacts 520, 526, and 528 mounted in the first area 50 of the plug connection portion 46 adjacent the distal end 52. Initially, the contacts extend substantially perpendicularly to the printed circuit board and then extend upwardly and backwardly toward wire termination portion 48. The second row comprises contacts 522, 524 and 532 mounted in the first area 50 of the plug connection portion 46 adjacent the proximal end 64, but further from the proximal end then the third row of contacts, and extend generally upwardly and backwardly toward wire termination portion 48. The third row comprises the pair of contacts 532 and 534 mounted in the first area 50 of the plug connection portion adjacent the proximal end 64 and extend generally upwardly and backwardly toward the wire termination portion. This configuration performs similarly to the embodiments of FIGS. 10 and 11.

Figure 13:
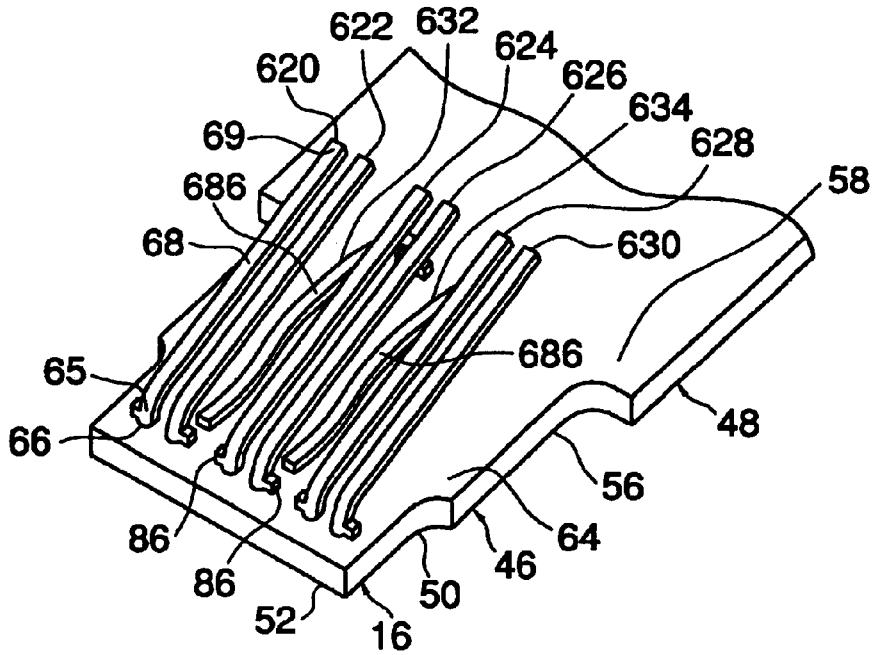
FIG. 13 is a partial top perspective view of a printed circuit board for a wire connecting unit having a contact configuration according to a seventh embodiment of the present invention.

Embodiment of FIG. 13

In FIG. 13, the contact configuration has a first pair of contacts 620 and 622, a second pair of contacts 624 and 626, and third pair of contacts 628 and 630 mounted in a cantilever manner in first area 50 of plug connection portion 46 adjacent free end 52. Initially, these six contacts extend substantially perpendicularly to the printed circuit board and then extend upwardly and backwardly toward the near end of the plug termination portion. A fourth pair of contacts 632 and 634 is mounted in the second area 56 of the plug termination portion 46 adjacent the near end 58 in a cantilever manner. Contacts 632 and 634 extend upwardly and forwardly toward free end 52. The first, second and third pairs of contacts extend in a row in which each contact is substantially equidistant from the free end. Each contact in the first, second, and third pairs of contacts has a single push foot 86 extending laterally and outwardly from its proximal end 65, remote from the other contact in its respective pair of contacts. The contacts in the fourth pair are aligned so that each contact is substantially equidistant from the near end.

Contacts 620, 622, 624, 626, 628, and 630 extend at angle of about 60–70 degrees relative to the printed circuit board, in a similar configuration as described above. Contacts 632 and 634, however, initially extend substantially vertically relative to the printed circuit board and then curve toward the free end at an angle preferably less than 60 degrees. Contacts 632 and 634 then curve downwardly toward the surface of the printed circuit board, forming a protrusion 688. The protrusion allows the plug to easily mate with contacts 632 and 634 without contacting the distal end of the contacts.

This configuration of contacts provides maximum separation between contacts 632 and 634 and the other contacts, reducing unwanted electromagnetic coupling therebetween The physical lay out of contacts 620 and 632 produce a electromagnetic field that is equal and opposite to the field produced by contacts 634 and 630 so each field is canceled out, enabling the electromagnetic coupling to be induced. This configuration also induces backward wave coupling, since the electromagnetic wave is traveling in opposite directions through adjacent contacts. Additionally, return loss is improved due to the fact that each contact in first through third pair of contacts are immediately adjacent its respective pair.

Figure 14:
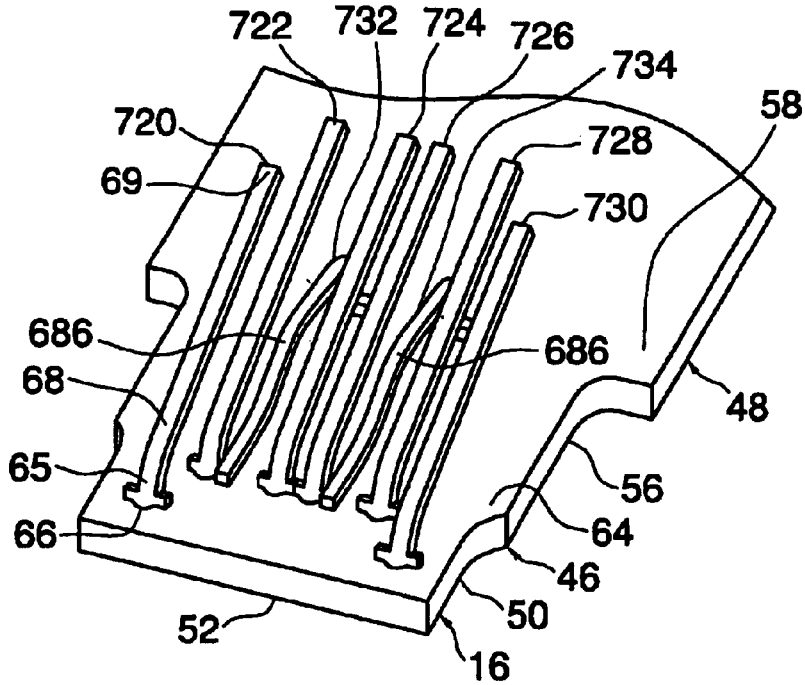
FIG. 14 is a partial top perspective view of a printed circuit board for a wire connecting unit having a contact configuration according to a eighth embodiment of the present invention.

Embodiment of FIG. 14

The FIG. 14 configuration is similar to the embodiment of FIG. 13, however, contacts 722, 724, 726 and 728 form an additional row that is adjacent the proximal end 64 of the first area 52 of the plug connection portion 46. Contacts 720, 730, 732 and 734 are in the same configuration as that of the embodiment in FIG. 13. This configuration of contacts provides maximum separation between contacts 732 and 734, reducing unwanted electromagnetic coupling between these two contacts. The physical lay out of contacts 720 and 732 produce a electromagnetic field that is equal and opposite to the field produced by contacts 734 and 730 so each field is canceled out, enabling the electromagnetic coupling to be induced. This configuration also induces backward wave coupling, since the electromagnetic wave is traveling in opposite directions through adjacent contacts. However, since all the pairs of contacts are not immediately adjacent one another the return loss is not as preferable as the embodiment of FIG. 13.

Figure 15:
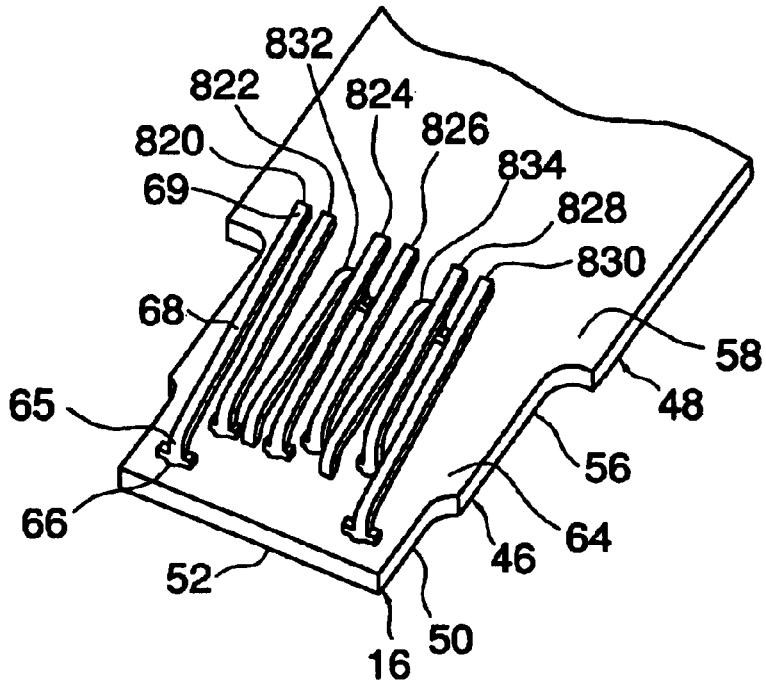
FIG. 15 is a partial top perspective view of a printed circuit board for a wire connecting unit having a contact configuration according to a ninth embodiment of the present invention.

Embodiment of FIG. 15

The embodiment of FIG. 15 is similar to the embodiment of FIG. 14. Contacts 820, 822, 824, 830, 832, and 834 are placed in a substantially similar configuration as the corresponding contacts of the embodiment of FIG. 14; however, contacts 826 and 828 are positioned closer to the proximal end 64 of the first area 50 of the plug connection portion 46 than contacts 822 and 824, thus, creating a fourth row of contacts. This configuration performs similarly to the embodiment of FIG. 14. However, since there is less separation between the contacts at the near end and the contacts at the proximal end 64, performance is reduced.

Figure 16:
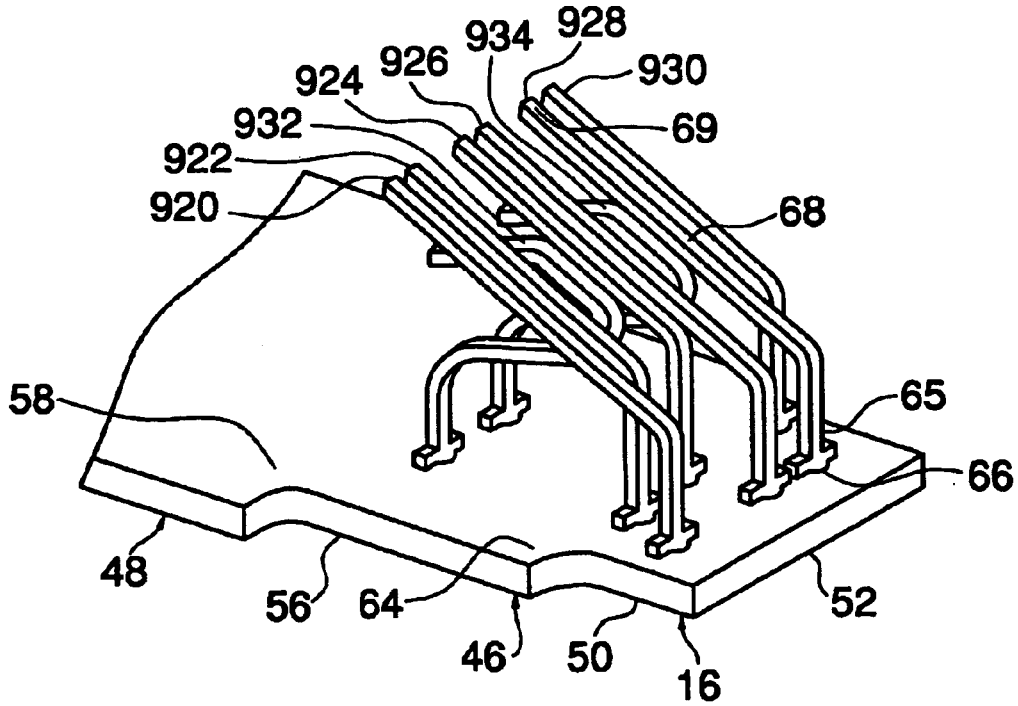
FIG. 16 is a partial top perspective view of a printed circuit board for a wire connecting unit having a contact configuration according to a tenth embodiment of the present invention.

Embodiment of FIG. 16

The FIG. 16 embodiment is similar in configuration to the embodiment of FIG. 12, in that it has three rows. The first row comprises contacts 920, 926, and 928 mounted in the first area 50 of the plug connection portion 46 adjacent the distal end 52 and extending upwardly and backwardly toward wire termination portion 48. The second row comprises contacts 922, 924 and 932 mounted in the first area 50 of the plug connection portion 46 adjacent the proximal end 64, but further from the proximal end 64 then the third row of contacts and extending generally upwardly and backwardly toward the wire termination portion 48. The third row comprises contacts 932 and 934 mounted in the first area 50 of the plug connection portion 46 adjacent the proximal end 64 and extend substantially perpendicularly from the printed circuit board 16. Contacts 932 and 934 then curve forward toward the free 52 end before curving generally upwardly and backwardly toward the wire termination portion 48. This configuration performs similarly to the configuration of the embodiments of FIG. 14 and 15, since there is separation between contacts 932 and 934. However, in this configuration, the contacts extend in a substantially similar direction (i.e. upwardly and backwardly) and therefore, there is no backward wave coupling.

Even though some of the configurations do not have the same enhanced performance as other configurations mentioned above, some configurations having shorter contacts, for example, the configurations shown in FIGS. 11, 12, and 15, and may be more desirable, since the mechanical layout may improve their performance when deflected to the deflection limits.

The features of the contact configurations of the embodiments shown in FIGS. 8–16, which are substantially similar to the embodiment shown in FIGS. 1–7 are identified with like reference numbers. The same description of those similar features is applicable to the embodiments shown in FIGS. 8–16. Additionally, the description of other elements of the wiring unit, such as the printed circuit board, housing, and all other aspects of the wiring unit, apply to the embodiments in FIGS. 8–16.

While specific embodiments have been chosen to illustrate the invention, it will be understood by those skilled in the art that various changes and modifications can be made therein without departing from the scope of the invention as defined in the appended claims.

What is claimed is:

1. A wire connecting unit for an electrical connector, comprising:

a circuit board defining a plane and having first and second areas, said first area having a near end and a free end;

first, second, and third pairs of contacts mounted in said first area adjacent said free end in a cantilever manner and extending upwardly and backwardly toward said near end, each said pair of contacts having a first contact and a second contact, said first contact in each of said first, second and third pairs being mounted laterally adjacent said second contact in a respective pair so that a line extending through said first and second contacts in each of said first, second and third pairs is adjacent the plane of the circuit board substantially parallel to said free end of said circuit board;

a fourth pair of contacts mounted in said first area adjacent said near end in a cantilever manner and extending upwardly and forwardly toward said free end, thereby enhancing electrical performance, said fourth pair having first and second contacts each of said first contacts in said first second, third and fourth pairs being substantially parallel with said second contact in each said pair, said first contact of each said first, second and third pairs being mounted adjacent said second contact of the respective pair, each of said pairs being substantially parallel, and distal and proximal ends of each of said contacts of said pairs of contacts, said proximal ends of said first, second and third pairs each having only a single push foot, each said line extending through said first and second contacts extending through said proximal end of each said contact.

2. A wire connecting unit according to claim 1, wherein each said single push foot extends laterally and outwardly from said proximal end of the respective contact remote from the other contact in the respective pair.

3. A wire connecting unit according to claim 1, wherein said pairs of contacts are mounted to said circuit board by inserting each of said contacts into a respective aperture in said circuit board.

4. A wire connecting unit according to claim 1, wherein the lines extending through said first and second contacts in each of said first, second and third pairs of contacts form a single substantially straight line that is substantially parallel to the free end of the circuit board.

5. A wire connecting unit according to claim 1, wherein each of said first and second contacts of said first, second and third pairs comprises a vertical portion ending in a bend and a horizontal portion extending along a substantial straight line from said bend to a free end thereof.

6. A wire connecting unit for an electrical connector, comprising:

a circuit board defining a plane and having first and second areas, said first area having a near end and a free end;

first, second, and third pairs of contacts mounted in said first area adjacent said free end in a cantilever manner and extending upwardly and backwardly toward said near end, each said pair of contacts having a first contact and a second contact, said first contact in each of said first, second and third pairs being mounted laterally adjacent said second contact in a respective pair so that a line extending through said first and second contacts in each of said first, second and third pairs is adjacent the plane of the circuit board substantially parallel to said free end of said circuit board;

a fourth pair of contacts mounted in said first area adjacent said near end in a cantilever manner and extending upwardly and forwardly toward said free end, thereby enhancing electrical performance, said fourth pair having first and second contacts, each of said first contacts in said first, second, third and fourth pairs being substantially parallel with said second contact in each said pair; and each of said first and second contacts of said first, second and third pairs having a vertical portion ending in a bend and a horizontal portion extending along a substantially straight line from said bend to a free end thereof.

* * * * *